United States Patent [19]

Lamirand et al.

[11] Patent Number: 5,032,419

[45] Date of Patent: Jul. 16, 1991

[54] METHOD OF ELECTROSTATICALLY DEPOSITING SMALLER PARTICLES FIRST

[75] Inventors: Joseph B. Lamirand, Muncie, Ind.; Dwight B. Raddatz, Woodridge, Ill.

[73] Assignee: Ball Corporation, Muncie, Ind.

[21] Appl. No.: 457,012

[22] Filed: Dec. 26, 1989

[51] Int. Cl.[5] ..... B05D 1/04

[52] U.S. Cl. ..... 427/25; 427/32; 427/33

[58] Field of Search ..... 427/27, 32, 33, 25

[56] References Cited

U.S. PATENT DOCUMENTS 2,328,577 9/1943 Oglesby ..... 427/32 X 4,066,803 1/1978 Scholes et al. ..... 427/27 X 4,500,561 2/1985 Kim et al. ..... 427/32 X

*Primary Examiner*—Evan Lawrence

*Attorney, Agent, or Firm*—Gilbert E. Alberding

[57] ABSTRACT

A method for electrostatically depositing a first material, such as a lubricant, onto a second material where the first material comprises particles ranging in size from smaller to larger. The method comprises depositing the smaller particles of the first material onto adjacent portions of the second material moving through a depositing chamber and progressively depositing the larger particles of the first material onto the adjacent portions of the second material generally subsequent to the first depositing step.

13 Claims, 3 Drawing Sheets

METHOD OF ELECTROSTATICALLY DEPOSITING SMALLER PARTICLES FIRST

BACKGROUND OF THE INVENTION

1. Field of the Invention

The present invention relates to apparatus and method for electrostatically depositing coatings. More particularly, the present invention relates to apparatus and method for electrostatically coating substrates, such as sheets or coils of metallic or non-metallic materials, with particulate materials, and for minimizing ecological contamination by depositing smaller particles first.

2. Description of the Related Art

The process of electrostatic depositing is used for depositing various kinds of materials onto metal objects or sheets. Uses for electrostatic depositing include depositing of: paint, dry powder coatings, abrasives, flocking materials, and lubricants. In addition, electrostatic depositing is used to reproduce printed material and pictures by the process that is known as xerography.

Examples of the related art in depositing of lubricants are: Scholes et al., U.S. Pat. No. 4,066,803, issued 3 Jan. 1978; and Jenkins et al., U.S. Pat. No. 2,608,176, issued 16 Mar. 1948. In like manner, Escallon, U.S. Pat. No. 4,526,804, issued 2 Jul. 1985, and Rocks et al., U.S. Pat. No. 3,155,545, issued 27 Feb. 1961, are examples of the related art in depositing granular materials; whereas Wiggins, U.S. Pat. No. 3,937,180, issued 10 Feb. 1976, and Cosentino et al., U.S. Pat. No. 4,742,154, issued 9 Feb. 1988, are examples of patents which teach electrostatic depositing of paint.

Two problems have attended electrostatic depositing. One is that the process of electrostatic depositing can develop a residual electrostatic potential on the coated material. Where materials with dielectric properties, such as lubricants, are deposited, the deposited material can retain a residual electrostatic charge. In the case of electrostatically lubricated metallic sheets, the residual electrostatic charge has caused sheets in a stack to stick together, and has electrostatically attracted contaminants from the air to lodge on the coated material.

The second problem is that of meeting increasingly strict ecological standards in that some of the coating material drifts out, or is blown out, of the depositing chamber.

A primary cause of the coating material drifting out of the depositing chamber is that, as the substrate becomes electrostatically coated, it can acquire the charge of the deposited material, reducing the electrical potential between the charged particles which are to be deposited and the substrate, and thereby allowing charged particles to drift out of the depositing chamber rather than being attracted to the depositing surface.

It has been found that, even though a metallic sheet or coil of metallic material is exposed to contact with the transporting apparatus, the surface of the sheet or coil can retain an electrical potential sufficient to spark to a metallic object that is spaced from the coated sheet or coil. This is particularly true of sheets.

The related art includes some attempts to correct the problem of a residual electrostatic charge. For instance, Gibbons et al., U.S. Pat. No. 3,702,258, issued 7 Nov. 1972, teach a method for neutralizing the residual electrostatic charge that remains after treating a web with an alternating current corona field to increase its printability. The apparatus of Gibbons et al. includes a positively energized roller and a negatively energized roller which contact the web, and a pair of electrodes that are spaced apart from respective ones of the rollers on opposite sides of the web from that of the rollers, and that are connected to a potential that is intermediate of the potentials of the two rollers.

Also, in U.S. Pat. No. 4,517,143, issued 14 May 1985, Kisler teaches passing a randomly charged web through two oppositely-charged electrostatic fields to adjust the electrostatic field charge level to a desired, and uniform, level.

With regard to the ecological problem, the usual attempts have involved pulling excess coating material through the depositing chamber with an air evacuating system. Typical of these systems is Rocks et al., U.S. Pat. No. 3,155,545.

SUMMARY OF THE INVENTION

In the present invention, smaller particles of a material, such as a lubricant, are progressively deposited onto a substrate, such as a sheet or coil of metallic or non-metallic material, and larger particles are deposited progressively onto the substrate subsequent to depositing the smaller particles.

The method includes supplying particles to a first end of a depositing chamber, generally separating smaller particles from larger particles, transporting the smaller particles to a second end of the depositing chamber, and transporting the substrate through the depositing chamber from the second end to the first end.

In a first aspect of the invention, as shown in FIG. 4, particles of the material to be deposited are generated by a particle generator and are supplied to a first end of a depositing chamber, and a substrate is transported through the depositing chamber, starting at a second end and moving toward the first end thereof.

In a second aspect of the invention, as shown in FIG. 5, a separate neutralizing chamber, an oppositely-charged electrode, and a separate particle generator cooperate to reduce the residual electrostatic charge of the coated substrate.

In a third aspect of the invention, as shown in FIG. 6, a deflector and an electrode that has been repositioned in the depositing chamber, cooperate to draw particles of the depositing material into the depositing chamber, and to direct the particles toward the substrate.

DESCRIPTION OF THE PREFERRED EMBODIMENTS

Figure 1:
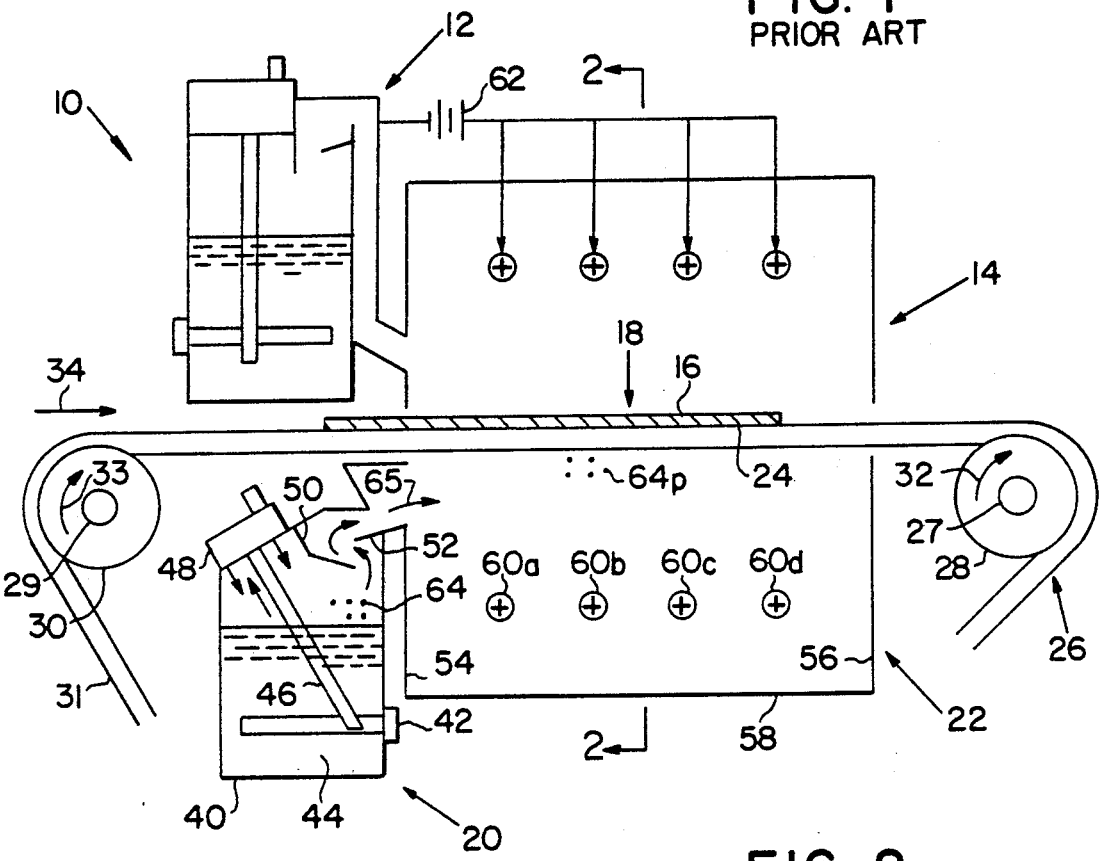
FIG. 1 PRIOR ART
FIG. 1 is a longitudinal cross-sectional elevation of prior art apparatus for electrostatically depositing a particulate material onto a substrate, and includes one depositing chamber for electrostatically coating the top surface of the substrate and another depositing chamber for electrostatically coating the bottom surface of the substrate.
Figure 2:
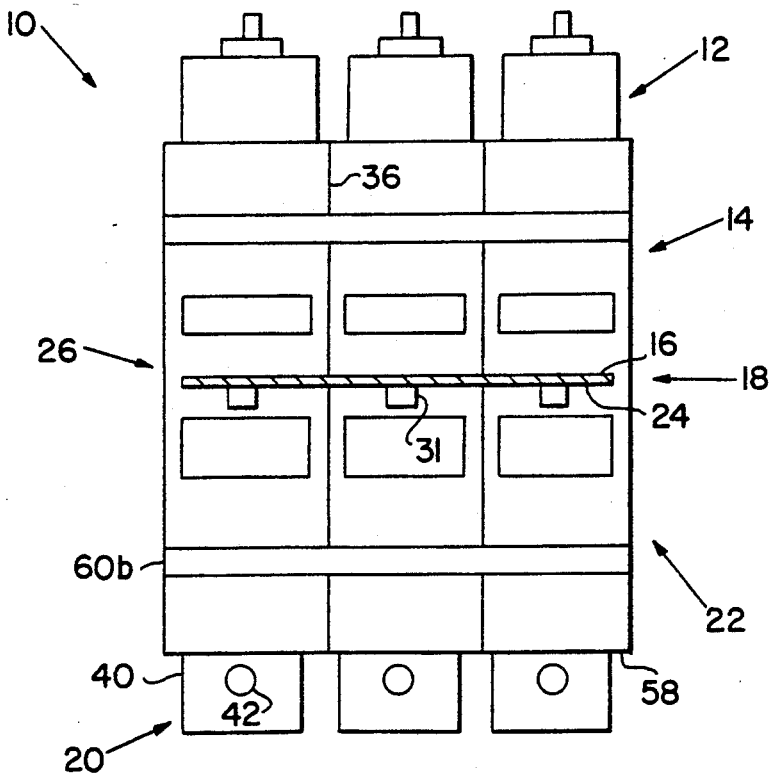
FIG. 2 PRIOR ART
FIG. 2 is a transverse cross-sectional elevation of the prior art apparatus of FIG. 1 taken substantially as shown by section line 2—2 of FIG. 1.

Referring now to the drawings, and more particularly to FIGS. 1 and 2, the prior art device shown in FIGS. 1 and 2 corresponds generally to the apparatus of Scholes et al., U.S. Pat. No. 4,066,803, and FIG. 1 corresponds more particularly to FIG. 9 of the aforesaid patent.

Continuing to refer to the prior art apparatus as shown in FIGS. 1 and 2, and electrostatic depositing apparatus 10 includes a first particle generator 12 and a first depositing chamber 14 for depositing lubricant onto a top surface 16 of a work piece, or sheet, 18 of metallic material. In like manner, the electrostatic depositing apparatus 10 includes a second particle generator 20 and a second depositing chamber 22 for depositing lubricant onto a bottom surface 24 of the sheet 18 of material.

The electrostatic depositing apparatus 10 also includes a transporting mechanism 26 which transports the sheets 18 through, or between, the depositing chambers, 14 and 22. The transporting mechanism 26 includes a drive shaft 27 onto which are mounted drive pulleys 28, a driven shaft 29 upon which are mounted driven pulleys 30, and conveyor belts 31 which interconnect the drive pulleys 28 and the driven pulleys 30. The direction of rotation of the pulleys 28 and 30 are indicated by arrows 32 and 33; and the direction of transport of the sheet 18 is indicated by an arrow 34.

The aforesaid patent of Scholes et al. shows and describes the mechanism, and the mechanical details, for transporting the sheets 18, whereas the present invention does not involve mechanical details. Therefore, it is unnecessary to describe these mechanical details herein. For instance, Scholes et al. show and describe the use of a plurality of drive pulleys, a plurality of driven pulleys, and a plurality of belts to transport a sheet 18 through their depositing chambers.

Further, Scholes et al. show and describe the use of a plurality of particle generators, 12 and 20, each providing a mist of lubricant for a portion of the width of the sheet 18, and they show and describe the use of longitudinally-disposed partitions 36 for dividing the depositing chamber into a plurality of depositing chambers 14 and 22. Each of the particle generators, 12 and 20, provide aspirated lubricant for one of the depositing chambers 14 and 22.

Further, even though the particle generators, 12 and 20, are somewhat different in appearance, their function is the same. Therefore, Applicant will describe only the portion of the depositing apparatus 10 which deposits lubricant onto the bottom surface 24 of the sheets 18.

The particle generator 20 includes a reservoir 40, an electric heater 42 that is disposed in a pool 44 of lubricant, a suction tube 46 which is disposed in the pool 44 of lubricant, an aspirator 48, and particle-separation baffles, 50 and 52.

The depositing chamber 22 includes a first end 54, a second end 56, and a bottom cover 58. Depositing electrodes **60*a*, 60*b*, 60*c*, and 60*d* are transversely disposed in the depositing chamber 22, are equidistantly spaced from each other, and are energized to a positive polarity by a source of high voltage that is symbolized by a battery 62. The positive polarity of the electrodes 60*a*–60*d* is indicated by the "+" signs in FIG. 1**.

In operation, the pool 44 of lubricant in the reservoir 40 is kept in a liquid state by the heater 42; and lubricant is drawn up into the suction tube 46 by air being blown through a venturi, not showm, in the aspirator 48. The lubricant is then aspirated out of the aspirator 48 in droplets, or particles of lubricant 64, of various sizes. The largest ones of the particles 64, which comprise ninety percent of the total number of particles 64, drop back into the pool 44 of lubricant because they are unable to navigate a tortuous path, which is generally designated by arrows 65, and which is provided by the particle-separation baffles, 50 and 52.

In contrast to the largest of the particles 64, the remainder of the particles 64, which have diameters between one and ten microns, form a cloud of particles 64 which drifts through the particle-separation baffles, 50 and 52.

It is accurate to speak of the remainder of the particles 64 drifting through the particle-separation baffles, 50 and 52, because typically an air pressure of 10–30 pounds per square inch and an orifice diameter of 0.05 inches is used to aspirate the lubricant, producing an air flow in the neighborhood of merely 0.8 to 1.4 cubic feet per minute.

The air that is used by the particle generator 20 is sufficient to transport the smaller of the particles 64 toward the second end 56 of the depositing chamber 22. Therefore, it is also accurate to speak of the smaller of the particles 64 being transported from the first end 54 to the second end 56 of the depositing chamber 22. In like manner, since the supply of air to the particle generator 20 is so small, the air is unable to transport the larger of the particles toward the second end 56 of the chamber 22 before they are deposited; thus, it is accurate to speak of the smaller of the particles 64 being separated from the larger of the particles 64.

As the remainder of the particles 64 drift toward the depositing chamber 22, the electrodes, **60*a*–60*d*, which are energized by a voltage potential that is sufficient to produce a corona discharge, ionize the surrounding atmosphere, charging the atmosphere, and resulting in the formation of charged particles which collide with the particles 64 of lubricant, and charge the particles 64 within the depositing chamber 22** to the positive polarity.

The positively-charged particles are referred to hereafter as particles **64*p***.

The positively-charged particles **64*p* are attracted to the sheet 18 of metallic material which initially is at, or near, ground potential, as shown by the electrical schematic of FIG. 1**.

Figure 3:
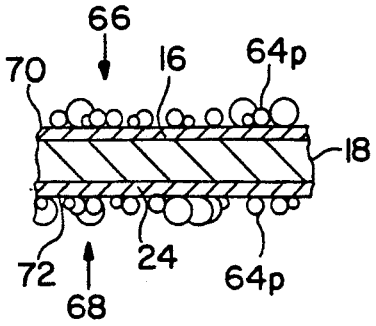
FIG. 3 PRIOR ART
FIG. 3 is an enlarged cross section of a portion of a substrate which has been coated on both sides with a coating such as a paint, and which has been electrostatically coated subsequently with spheres of a lubricant.

Referring now to FIGS. 1 and 3, as the sheet 18 is transported through the depositing chamber 22 at a velocity upwardly of 300 feet per minute, and as particles **64*p* of lubricant are electrostatically deposited, the top and bottom surfaces, 16 and 24, of the sheet 18** start to build up a positive electrostatic charge.

Referring now to FIGS. 1-3, as the sheet 18 proceeds from the first end 54 to the second end 56 of the depositing chamber 22, and as the electrostatic depositing of the particles 64*p* continues progressively, a positive charge may build up to a potential which results in sparking from the metallic sheet 18 to a part of the apparatus, not shown, that is as much as twelve centimeters away from the sheet 18.

Referring now to FIG. 3, the sheet 18 has been coated previously with layers of paint, 70 and 72. On top of these layers of paint, 70 and 72, are the coatings, 66 and 68, of lubricant. Since the layers of paint, 70 and 72, can isolate the charged lubricant particles from the metal sheet and from "ground", and since the areas of the surfaces, 16 and 24, of the sheet 18 are quite large, it is apparent that the painted and lubricated sheet 18 can develop a tremendously large electrical charge. Thus, with some sheets, a very large electrostatic charge can remain on the sheet 18, even though the sheet 18 is contacted by the apparatus, and it is understandable that this large charge can cause problems.

As noted previously, problems which attend this electrostatic charging of the sheet 18 include: 1) lubricated sheets that tend to stick together; and 2) a build-up of electrostatic charge that decreases the attraction of positively-charged particles, so that an excessively large percentage of the particles 64*p* drift out of the depositing chamber 22.

Figure 4:
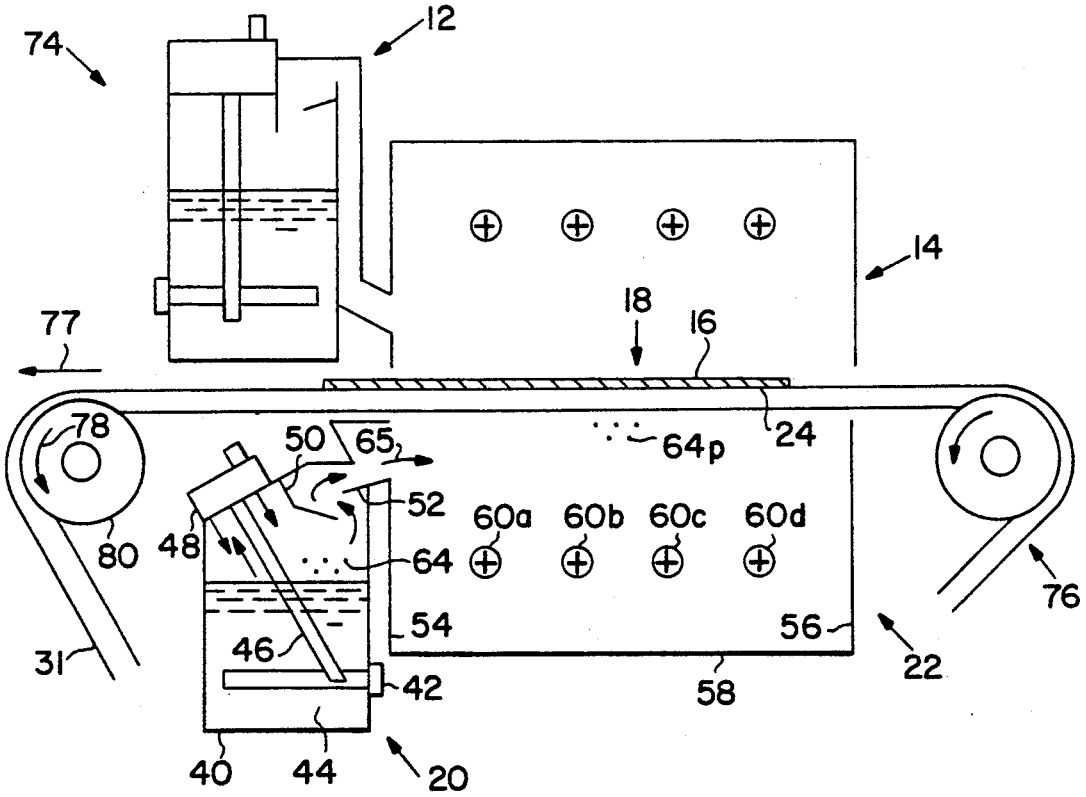
FIG. 4 is a cross-sectional elevation of a first embodiment of the present invention wherein a particle generator supplies a particulate material into a first end of a depositing chamber, and a transporting mechanism transports the work pieces through the depositing chamber starting opposite from the first end thereof.

Referring now to FIG. 4, a depositing apparatus 74 illustrates a first preferred embodiment of the present invention. Since the prior art embodiment of FIG. 1 and the first preferred embodiment of FIG. 4 include like-numbered and like-named parts, they will not be recited except as necessary to describe the operation and advantages of the depositing apparatus 74 of FIG. 4.

The embodiments of FIGS. 1 and 4 are identical except that the direction of transport of the sheet 18 is opposite with respect to the location of the particle generator 20. That is, the direction of transport is from the second end 56 of the depositing chamber 22, and toward the first end 54 of the depositing chamber 22 wherein the particles 64 are supplied by the particle generator 20.

As shown in FIG. 4, the direction of transport of a transporting mechanism 76 is now shown by an arrow 77 on the belt 31, and by an arrow 78 on the pulley 80 which now becomes the drive pulley.

Since, as previously explained, the small quantity of air used by the particle generator 20 serves as a means to generally separate the smaller of the particles 64*p*, and to transport them toward the second end 56 of the depositing chamber 22, reversing the direction of transport causes the smaller of the particles 64*p* to be deposited onto the sheet 18 while it is bare, and before it becomes charged by positively-charged particles 64*p*.

Since the larger of the particles 64*p* are able to take a larger electrostatic charge, they are attracted to, and deposited on, the sheet 18 even after the sheet 18 has acquired a considerable positive charge.

In contrast, when the larger of the particles 64*p* are deposited first, as in prior art devices such as shown in FIG. 1, the smaller of the particles 64*p* are not attracted to the sheet 18 with sufficient force to prevent an unsatisfactorily large portion of them from escaping from the depositing chamber 22 rather than being electrostatically deposited onto the sheet 18.

Figure 5:
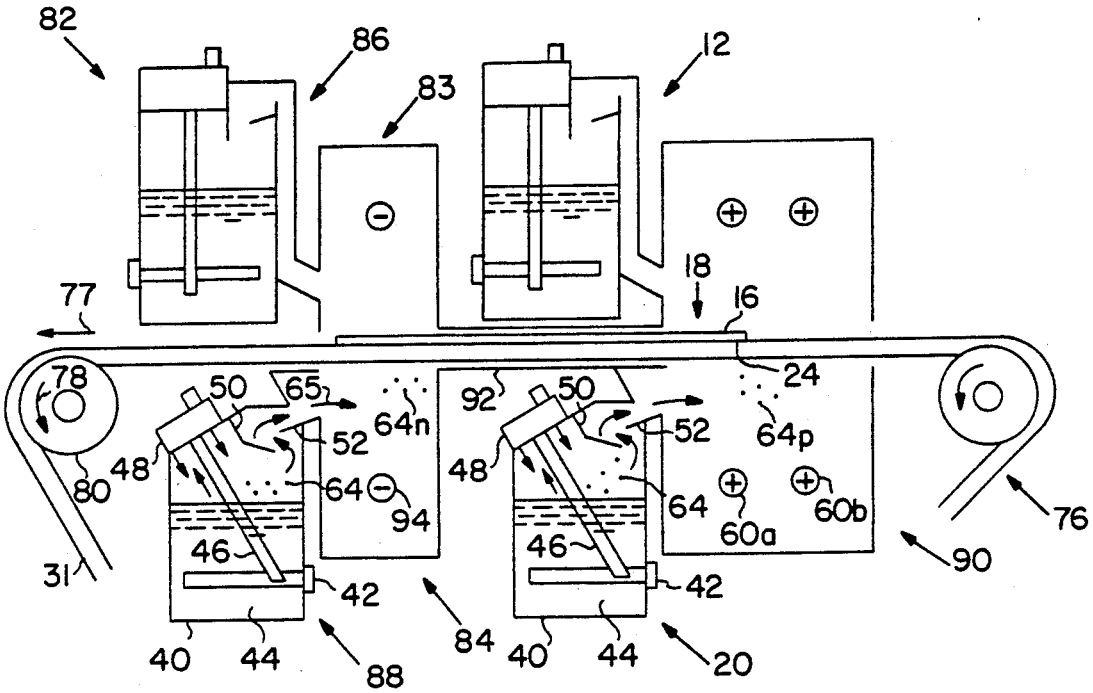
FIG. 5 is a cross-sectional elevation of a second embodiment of the present invention, and differs from the embodiment of FIG. 4 in that a separate neutralizing chamber and a separate particle generator are supplied to neutralize the electrostatic charge that remains on the work pieces subsequent to electrostatic depositing.

Referring now to FIG. 5, a depositing apparatus 82 illustrates a second preferred embodiment of the present invention. The direction of transport is the same as that of FIG. 4, as indicated by arrows 77 and 78.

The second embodiment of FIG. 5 varies from the first embodiment of FIG. 4 in that neutralizing chambers 83 and 84 have been added together with particle generators 86 and 88.

In operation, if positively-charged particles 64*p* escape from depositing chamber 90, and are conveyed to the neutralizing chamber 84 by a conduit 92, then they are recharged to be negatively-charged particles 64*n* by a neutralizing electrode 94 in the neutralizing chamber 84.

The negatively-charged particles 64*n* are attracted to the residual positive charge on the sheet 18, are electrostatically deposited thereon, and provide a means for neutralizing the residual electrostatic charge on the sheet 18.

If there is not a sufficient number of positively-charged particles 64*p* that escape from the depositing chamber 90, and that are transmitted to the neutralizing chamber 84, then the particle generator 88, can be adjusted to furnish the quantity of particles 64 that are needed to neutralize the residual charge on the sheet 18.

It should be recognized that, in neutralizing the sheet 18 by depositing oppositely-charged particles 64 thereon, the residual electrostatic charge, plus the charge on the particles, causes highly efficient depositing of particles 64 during the neutralizing process; so that ecologically the neutralizing process is extremely advantageous.

Figure 6:
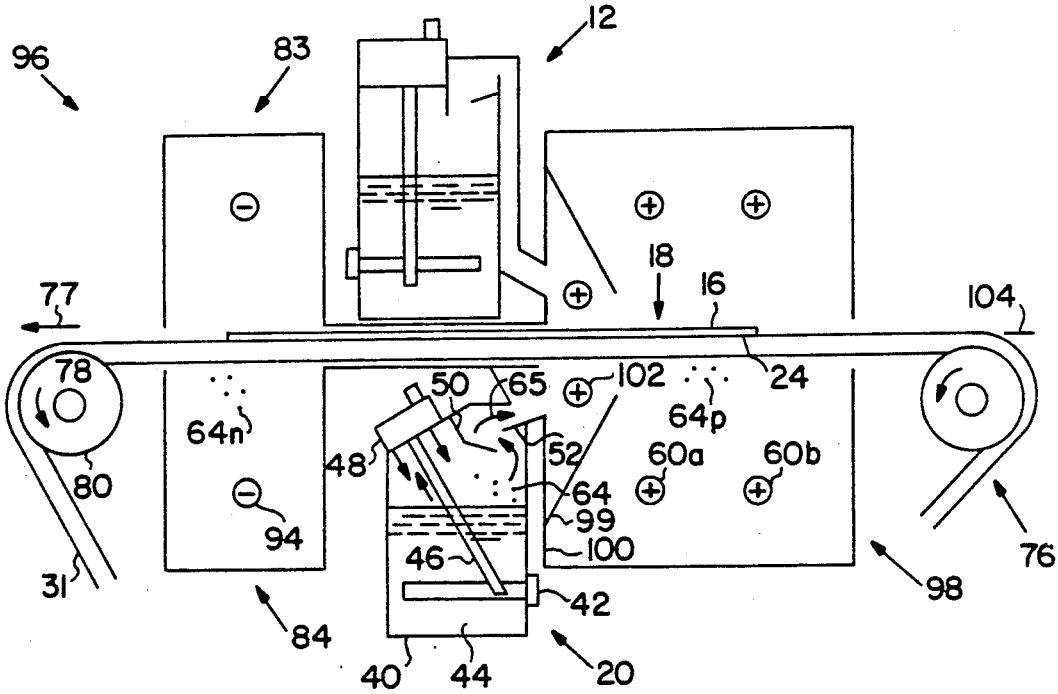
FIG. 6 is a cross-sectional elevation of a third embodiment of the present invention, and differs from the first two embodiments in that a repositioned electrode and a deflector cooperate to draw the particulate material into the depositing chamber and to direct the particulate material toward the substrate or work piece.

Referring now to FIG. 6, a depositing apparatus 96 illustrates a third embodiment of the present invention. Two depositing electrodes, 60*a* and 60*b*, are located in a depositing chamber 98, and are spaced in the manner shown and taught with respect to FIGS. 1, 4, and 5. In addition, the embodiment of FIG. 6 includes a mechanical deflector 99 that is located between the depositing electrode 60*a* and a first end 100 of the depositing chamber 98; and an accelerating electrode 102, is located between the deflector 99 and the first end 100 of the depositing chamber 98.

As shown in FIG. 6, the accelerating electrode 102 is located closer to the sheet 18, and a depositing path 104, than the depositing electrodes 60*a* and 60*b* are located.

In operation, the accelerating electrode 102, which is energized to a positive potential as indicated by the "+" marking thereon, draws particles 64 from the tortuous path designated by arrows 65, positively charges the particles 64, and causes a larger percentage of them to be deposited near the first end 100 of the depositing chamber 98, than occurs without inclusion of the deflector 99 and the accelerating electrode 102.

As described in conjunction with FIG. 5, the embodiment of FIG. 6 also includes a neutralizing chamber 84 and a neutralizing electrode 94, that function generally as described for the FIG. 5 embodiment.

Therefore, the FIG. 6 embodiment includes three aspects of the present invention, namely: depositing smaller particles first, directing particles toward the work piece by use of the deflector 99 and the accelerating electrode 102, and neutralizing the residual electrostatic charge on the sheet 18 by use of the neutralizing electrode 94.

In summary, in the present invention more efficient electrostatic depositing is achieved by depositing smaller particles 64 first and then subsequently depositing larger particles 64. Optimally, the improved efficiency of electrostatic depositing is further enhanced by recharging a portion of the particles 64 to the opposite polarity and/or by directing the particles 64 toward the work piece 18 by means of an accelerating electrode 102 and a mechanical deflector 99.

While specific apparatus and method have been disclosed in the preceding description, it should be understood that these specifics have been given for the purpose of disclosing the principles of the present invention and that many variations thereof will become apparent to those who are versed in the art. Therefore, the scope of the present invention is to be determined by the appended claims.

INDUSTRIAL APPLICABILITY

The present invention is applicable to electrostatic depositing of various materials, particularly materials which may be aspirated. More particularly, the present invention is applicable to electrostatically depositing lubricants, such as petrolatum.

What is claimed is:

1. A method for electrostatically depositing a first material onto a second material, said first material comprising particles ranging in size from smaller to larger, which method comprises:

a. progressively depositing said smaller particles of said first material onto adjacent portions of said second material; and b. progressively depositing said larger particles of said first material onto said adjacent portions of said second material generally subsequent to the first depositing step, said steps of progressively depositing said smaller and larger particles on to said second material comprising:

providing said smaller and said larger particles generally proximal a first end of a depositing chamber;

transporting said smaller particles generally proximal to a second end of said depositing chamber; and moving said second material through said depositing chamber in the direction wherein said adjacent portions are exposed to said smaller particles before being exposed to said larger particles.

2. A method as claimed in claim 1 wherein a. said providing step comprises providing a mixture of said smaller and said larger particles; and b. said transporting step comprises generally separating said smaller and said larger particles.

3. A method as claimed in claim 1 wherein a. said providing step comprises aspirating a mixture of said smaller and said larger particles; and b. said transporting step comprises generally transporting said smaller particles away from said larger particles.

4. A method as claimed in claim 1 wherein a. said providing step comprises providing a mixture of said smaller and said larger particles;

b. said transporting step comprises generally separating said smaller and said larger particles; and said moving step includes progressively exposing said second material to said smaller particles and progressively exposing said second material to said larger particles generally subsequently to the first said exposing step.

5. A method as claimed in claim 1 wherein a. said providing step comprises generating a mixture of said smaller and said larger particles; and b. said transporting step comprises generally transporting said smaller particles away from said larger particles.

6. A method for electrostatically depositing a lubricant onto a piece of metallic material, which method comprises:

a. aspirating smaller particles of said lubricant;

b. aspirating larger particles of said lubricant;

c. progressively depositing said smaller particles onto successive portions of said piece of metallic material; and d. progressively depositing said larger particles onto said metallic material generally subsequent to the first said depositing step.

7. A method for electrostatically depositing, which method comprises:

a. providing larger particles in a depositing chamber generally proximal to a first end thereof;

b. providing smaller particles in said depositing chamber generally proximal to a second end thereof;

c. transporting a work piece through said depositing chamber from said second end to said first end;

d. electrostatically depositing said smaller particles onto said work piece; and e. electrostatically depositing said larger particles onto said work piece generally subsequently to the first said depositing step.

8. A method as claimed in claim 7 in which said method further comprises electrostatically neutralizing said work piece subsequent to the first said electrostatic depositing step.

9. A method as claimed in claim 8 in which the first said electrostatic depositing step comprises electrostatically charging said smaller particles to a first polarity; and said neutralizing step comprises electrostatically charging said larger particles to the opposite polarity, and depositing said oppositely-charged particles onto said work piece.

10. A method as claimed in claim 7 wherein said depositing chamber includes:

a first electrode in said depositing chamber proximal to said second end at a first distance from a transporting plane of said work piece and a second electrode in said depositing chamber, proximal to said first end thereof, and closer to said transporting plane than said first distance.

11. A method as claimed in claim wherein said depositing chamber includes:

a first electrode in said depositing chamber proximal to said second end at a first distance from a transporting plane of said work piece; and a second electrode in said depositing chamber, proximal to said first end thereof, and closer to said transporting plane than said first distance; and said method further comprises deflecting said smaller and said larger particles toward said work piece intermediate of said first and second eletrodes.

12. A method as claimed in claim 7 in which said depositing chamber includes first and second electrodes in said depositing chamber; and said method further comprises deflecting said smaller and said larger particles toward said work piece intermediate of said first and second electrodes.

13. A method for electrostatically depositing a first material comprising smaller and larger particles onto a second material, which method comprises:

a. aspirating a mixture of said smaller and larger particles;

b. injecting said mixture of said smaller and larger particles into a depositing chamber proximal to a first end thereof;

c. transporting a portion of said smaller particles toward a second end of said depositing chamber;

d. progressively depositing said smaller particles of said first material onto adjacent portions of said second material by sequentially exposing said adjacent portions of said second material to said smaller particles proximal to said second end; and e. progressively depositing said larger particles of said first material onto said adjacent portions of said second material by exposing respective ones of said adjacent portions to said larger particles proximal to said first end generally subsequent to the depositing of the small particles onto said second material.

* * * * *